US007789994B2

(12) United States Patent
Hupp et al.

(10) Patent No.: US 7,789,994 B2
(45) Date of Patent: Sep. 7, 2010

(54) CLOTHLIKE NON-WOVEN FIBROUS STRUCTURES AND PROCESSES FOR MAKING SAME

(75) Inventors: Matthew Todd Hupp, Cincinnati, OH (US); Charles Allen Redd, Harrison, OH (US); Steven Lee Barnholtz, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 17 days.

(21) Appl. No.: 11/977,925

(22) Filed: Oct. 26, 2007

(65) Prior Publication Data

US 2008/0102261 A1 May 1, 2008

Related U.S. Application Data

(60) Provisional application No. 60/854,844, filed on Oct. 27, 2006.

(51) Int. Cl.
*D21H 27/00* (2006.01)
*B32B 5/00* (2006.01)

(52) U.S. Cl. ..... 162/109; 162/117; 162/118; 162/123; 428/156; 428/172

(58) Field of Classification Search ..... 162/109, 162/111, 117, 118, 123–133; 428/86, 90–93, 428/132–134, 136–139, 152–153, 156, 167, 428/172; 442/387, 389, 394
See application file for complete search history.

(56) References Cited

U.S. PATENT DOCUMENTS 6,155,083 A * 12/2000 Goeser et al. ..... 66/170
D445,261 S * 7/2001 Barnholtz et al. ..... D5/53
D448,935 S * 10/2001 Barnholtz et al. ..... D5/53
7,172,801 B2 * 2/2007 Hoying et al. ..... 428/92
7,410,683 B2 * 8/2008 Curro et al. ..... 428/133
2004/0131820 A1 * 7/2004 Turner et al. ..... 428/92
2004/0229008 A1 * 11/2004 Hoying ..... 428/92
2004/0242097 A1 * 12/2004 Hasenoehrl et al. ..... 442/59
2004/0265533 A1 * 12/2004 Hoying et al. ..... 428/92
2004/0265534 A1 * 12/2004 Curro et al. ..... 428/92
2005/0279470 A1 * 12/2005 Redd et al. ..... 162/109
2005/0281978 A1 * 12/2005 Cabell ..... 428/97
2005/0283129 A1 * 12/2005 Hammons et al. ..... 604/384
2006/0019056 A1 * 1/2006 Turner et al. ..... 428/85
2006/0286343 A1 * 12/2006 Curro et al. ..... 428/131
2007/0116926 A1 * 5/2007 Hoying et al. ..... 428/137
2007/0256802 A1 * 11/2007 Sheehan et al. ..... 162/123
2007/0256803 A1 * 11/2007 Sheehan et al. ..... 162/123
2008/0008853 A1 * 1/2008 Hupp et al. ..... 428/85
2008/0102261 A1 * 5/2008 Hupp et al. ..... 428/218
2008/0119807 A1 * 5/2008 Curro et al. ..... 604/367
2008/0154226 A9 * 6/2008 Hammons et al. ..... 604/384

FOREIGN PATENT DOCUMENTS

EP 963747 A1 * 12/1999
WO WO 2004058117 A1 * 7/2004
WO WO 2007001270 A1 * 1/2007
WO WO 2007130540 A2 * 11/2007
WO WO 2008050311 A2 * 5/2008

* cited by examiner

*Primary Examiner*—José A Fortuna
(74) *Attorney, Agent, or Firm*—C. Brant Cook

(57) ABSTRACT

Fibrous structures, more particularly non-woven fibrous structures that exhibit properties that consumers associate with cloths, sanitary tissue products incorporating such fibrous structures and processes for making such fibrous structures are provided.

27 Claims, 6 Drawing Sheets

CLOTHLIKE NON-WOVEN FIBROUS STRUCTURES AND PROCESSES FOR MAKING SAME

CROSS REFERENCE TO RELATED APPLICATION

This application claims the benefit of U.S. Provisional Application No. 60/854,844 filed Oct. 27, 2006.

FIELD OF THE INVENTION

The present invention relates to fibrous structures, more particularly to non-woven fibrous structures that exhibit properties that consumers associate with cloths, sanitary tissue products comprising such fibrous structures and processes for making such fibrous structures.

BACKGROUND OF THE INVENTION

Woven fabrics, such as cloths, exhibit properties that consumers, at least some consumers, would like to see in their non-woven fibrous structures and/or sanitary tissue products comprising such fibrous structures.

Numerous attempts have been made by formulators to achieve clothlike properties in non-woven fibrous structures, especially fibrous structures comprising pulp fibers. Such attempts have made progress, but consumers continue to have a need for non-woven fibrous structures that exhibit even more clothlike properties.

Accordingly, there exists a need for non-woven fibrous structures, especially pulp fiber-containing fibrous structures that exhibit clothlike properties, sanitary tissue products comprising such fibrous structures and processes for making such fibrous structures.

SUMMARY OF THE INVENTION

The present invention fulfills the needs described above by providing non-woven fibrous structures that exhibit clothlike properties and/or visual aspects that consumers associate with cloths, sanitary tissue products comprising such fibrous structures and processes for making such fibrous structures.

It has been unexpectedly found that non-woven fibrous structures that exhibit specific values for a combination of specific properties exhibit clothlike properties.

In one example of the present invention, a non-woven fibrous structure comprising a plurality of fibers, wherein the fibrous structure exhibits a wet caliper of greater than 25 mils and a flex modulus of less than 0.25 GM Bmean, is provided.

In another example of the present invention, a non-woven fibrous structure comprising a plurality of fibers, wherein the fibrous structure exhibits a wet caliper of greater than 25 mils and a VFS of greater than 10.2 g/g, is provided.

In even another example of the present invention, a non-woven fibrous structure comprising a plurality of fibers, wherein the fibrous structure exhibits a dry caliper of greater than 37 mils and a VFS of greater than 10.2 g/g, is provided.

In still another example of the present invention, a single- or multi-ply sanitary tissue product comprising a non-woven fibrous structure according to the present invention is provided.

In yet another example of the present invention, a process for making a non-woven fibrous structure according to the present invention is provided.

Accordingly, the present invention provides non-woven fibrous structures that exhibit certain properties that consumers of the non-woven fibrous structures associate with cloths, sanitary tissue products comprising such non-woven fibrous structures and processes for making such non-woven fibrous structures.

DETAILED DESCRIPTION OF THE INVENTION

Figure 1:
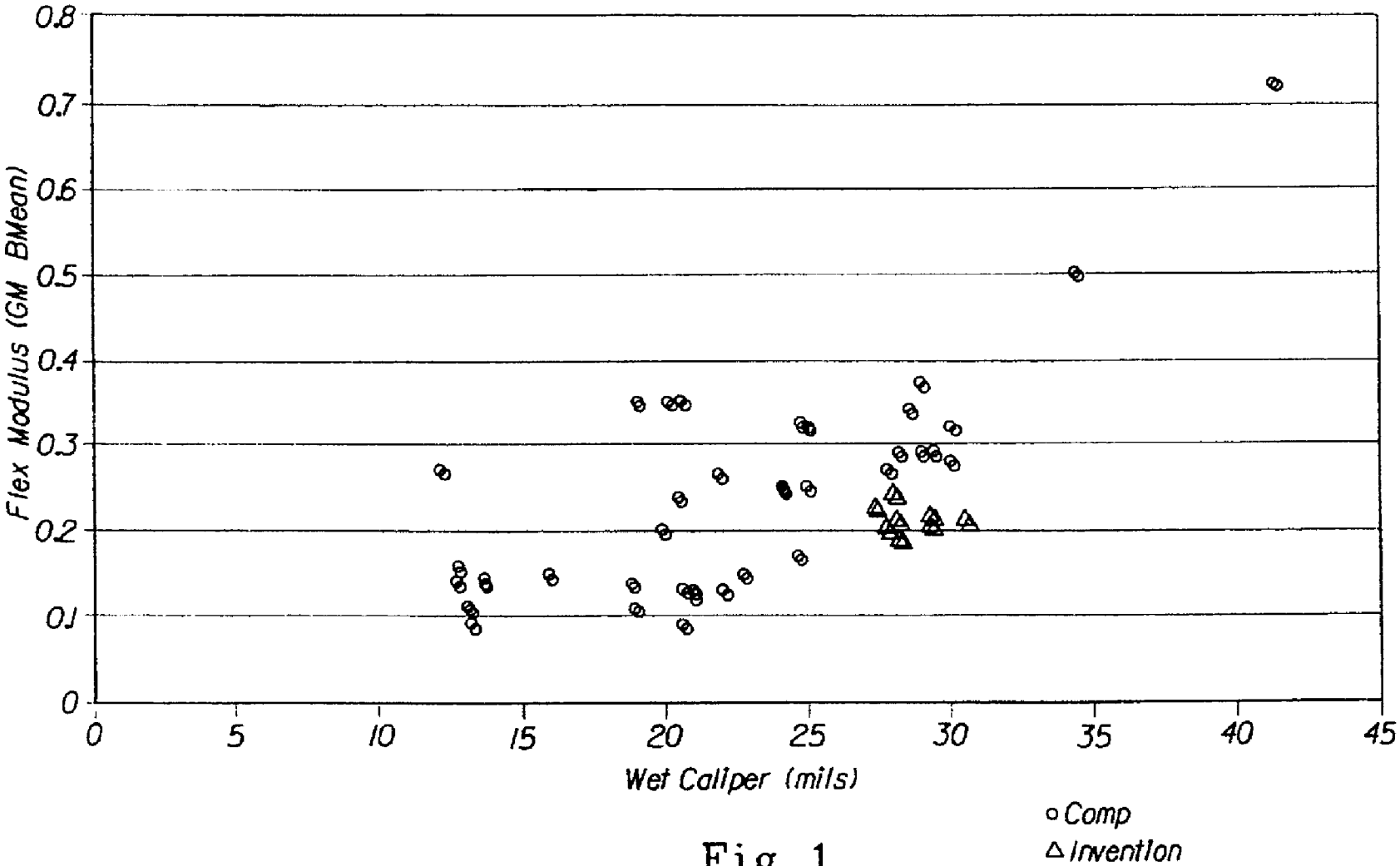
FIG. 1 is a plot of Flex Modulus vs. Wet Caliper for fibrous structures made in accordance with the present invention ("Invention") and prior art fibrous structures ("Comp"), illustrating the low flex modulus and high wet caliper exhibited by the fibrous structures of the present invention.
Figure 2:
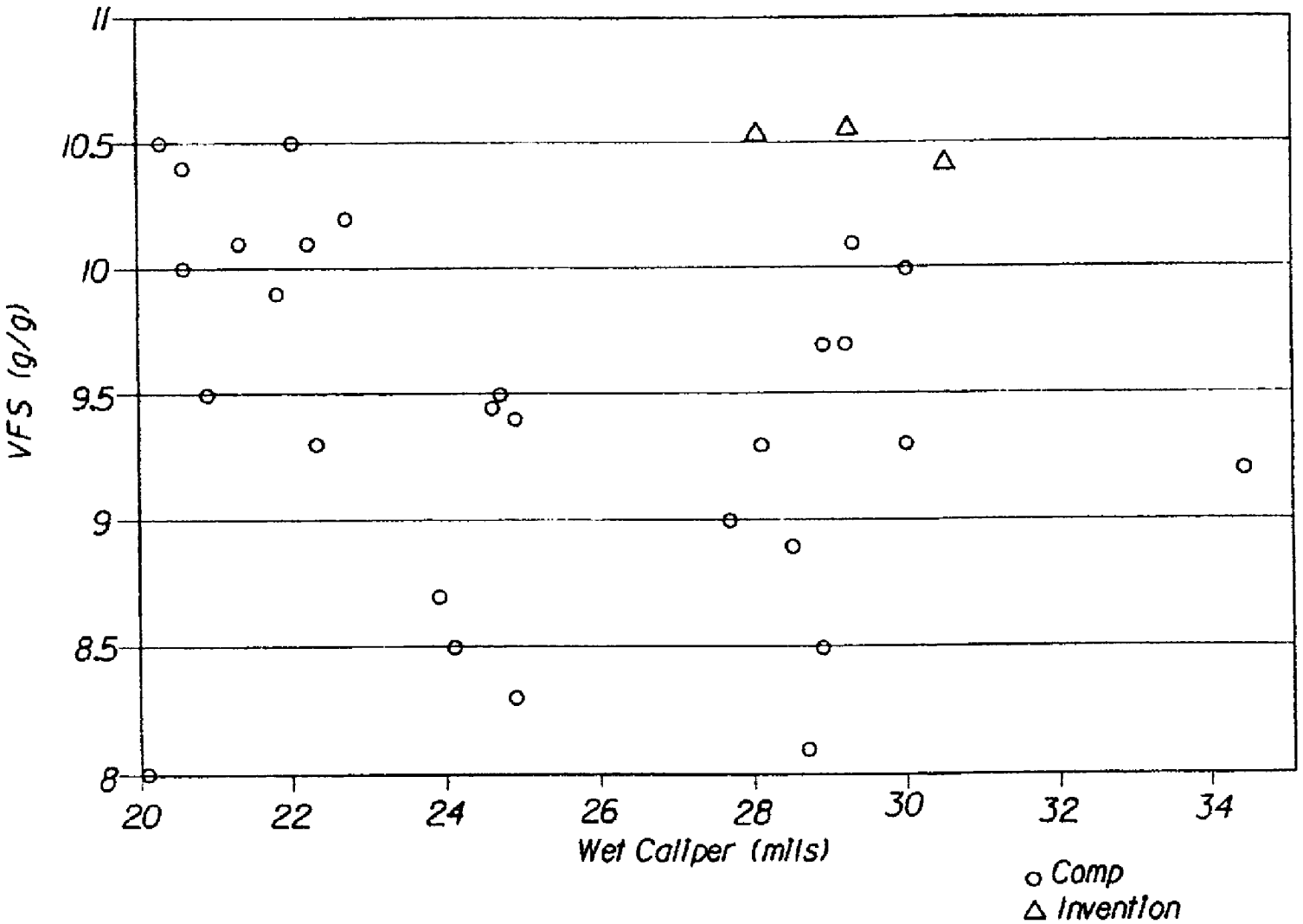
FIG. 2 is a plot of VFS vs. Wet Caliper for fibrous structures made in accordance with the present invention ("Invention") and prior art fibrous structures ("Comp"), illustrating the high VFS and wet caliper exhibited by the fibrous structures of the present invention.
Figure 3:
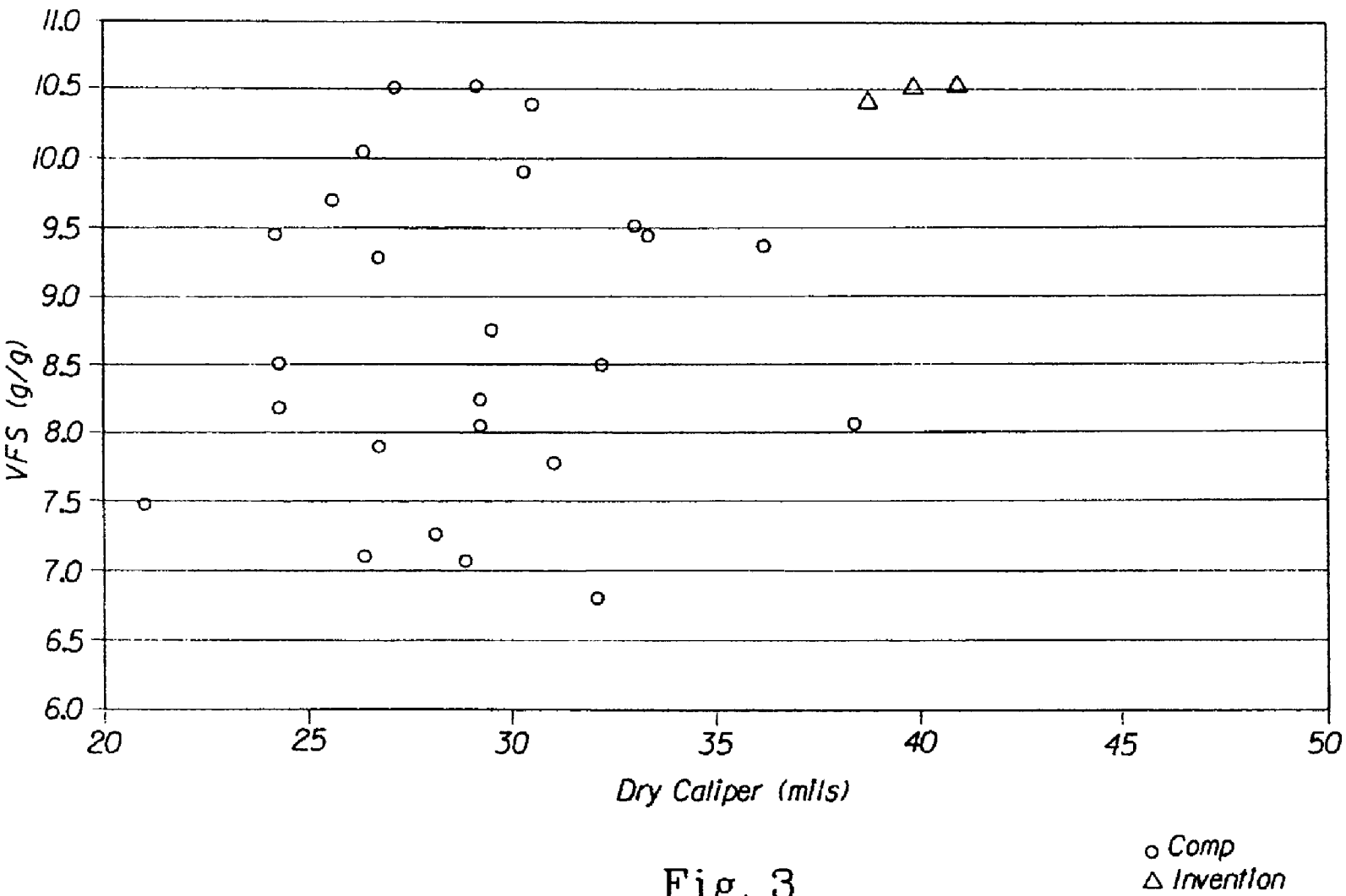
FIG. 3 is a plot of VFS vs. Dry Caliper for fibrous structures made in accordance with the present invention ("Invention") and prior art fibrous structures ("Comp"), illustrating the high VFS and dry caliper exhibited by the fibrous structures of the present invention.

"Clothlike" as used herein relates to the feel of the non-woven fibrous structure to a consumer, the appearance of the non-woven fibrous structure to a consumer and/or the performance (absorbency, strength, durability, etc.) of the non-woven fibrous structure during use by a consumer.

"Fibrous structure" as used herein means a structure that comprises one or more fibers. In one example, a fibrous structure according to the present invention means an orderly arrangement of fibers within a structure in order to perform a function. A bag of loose fibers is not a fibrous structure in accordance with the present invention.

"Non-woven fibrous structure" as used herein means a fibrous structure wherein fibers forming the fibrous structure are not orderly arranged by weaving and/or knitting the fibers together. In other words, non-woven fibrous structures do not include textiles and/or garments and/or apparel. The non-woven fibrous structures of the present invention are disposable (i.e., typically thrown away after one or two uses—unlike clothes, rags, cloths, etc.).

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, naturally-occurring fibers or synthetic (human-made) fibers, or any other suitable fibers, and any combination thereof.

"Naturally-occurring fibers" as used herein means animal fibers, mineral fibers, plant fibers (such as wood fibers, trichomes and/or seed hairs) and mixtures thereof. Animal fibers may, for example, be selected from the group consisting of: wool, silk and other naturally-occurring protein fibers and mixtures thereof. The plant fibers may, for example, be obtained directly from a plant. Nonlimiting examples of suitable plants include wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred.

In addition to the various wood fibers, other cellulosic fibers such as cotton linters, cotton and bagasse can be used in the fibrous structures of the present invention.

Synthetic (human-made) fibers ("non-naturally occurring fibers"), such as polymeric fibers, can also be used in the fibrous structures of the present invention. Elastomeric polymers, polypropylene, polyethylene, polyester, polyolefin, polyvinyl alcohol and nylon, which are obtained from petroleum sources, can be used. In addition, polymeric fibers comprising natural polymers, which are obtained from natural sources, such as starch sources, protein sources and/or cellulose sources may be used in the fibrous structures of the present invention. The synthetic fibers may be produced by any suitable methods known in the art.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a roll of sanitary tissue product.

"Basis Weight" as used herein is the weight per unit area of a sample reported in lbs/3000 ft$^2$ or g/m$^2$. Basis weight is measured by preparing one or more samples of a certain area (m$^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples (m$^2$). The basis weight (g/m$^2$) is calculated by dividing the average weight (g) by the average area of the samples (m$^2$).

"Caliper" or "Sheet Caliper" as used herein means the macroscopic thickness of a single-ply fibrous structure, web product or film according to the present invention. Caliper of a fibrous structure, web product or film according to the present invention is determined by cutting a sample of the fibrous structure, web product or film such that it is larger in size than a load foot loading surface where the load foot loading surface has a circular surface area of about 3.14 in$^2$. The sample is confined between a horizontal flat surface and the load foot loading surface. The load foot loading surface applies a confining pressure to the sample of 15.5 g/cm$^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

In one example, a non-woven fibrous structure and/or sanitary tissue product comprising such fibrous structure may exhibit a sheet caliper of at least about 0.508 mm (20 mils) and/or at least about 0.762 mm (30 mils) and/or at least about 1.524 mm (60 mils).

The fibrous structures of the present invention and/or sanitary tissue products of the present invention may exhibit a wet caliper as measured by the Wet Caliper Test Method described herein of greater than 23 mils. In one example, the fibrous structure of the present invention and/or sanitary tissue product of the present invention exhibits a wet caliper of greater than about 24 mils and/or greater than about 25 mils and/or greater than about 26 mils and/or greater than about 27 mils up to about 45 mils and/or up to about 40 mils and/or up to about 35 mils and/or up to about 33 mils.

The fibrous structures of the present invention and/or sanitary tissue products of the present invention may exhibit a dry caliper as measured by the Dry Caliper Test Method described herein of greater than 31 mils. In one example, the fibrous structure of the present invention and/or sanitary tissue product of the present invention exhibits a dry caliper of greater than about 32 mils and/or greater than about 34 mils and/or greater than about 35 mils and/or greater than about 37 mils and/or greater than about 38 mils up to about 60 mils and/or up to about 50 mils and/or up to about 45 mils and/or up to about 43 mils.

"Density" or "Apparent density" as used herein means the mass per unit volume of a material. For fibrous structures, the density or apparent density can be calculated by dividing the basis weight of a fibrous structure sample by the caliper of the fibrous structure sample with appropriate conversions incorporated therein. Density and/or apparent density used herein has the units g/cm$^3$.

"Dry Tensile Strength" (or simply "Tensile Strength" as used herein) of a fibrous structure and/or sanitary tissue product is measured as follows. One (1) inch by five (5) inch (2.5 cm×12.7 cm) strips of fibrous structure and/or sanitary tissue product are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 4.0 inches per minute (about 10.2 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Absorbent" and "absorbency" as used herein means the characteristic of the fibrous structure which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also. Absorbency is measured here in by the Horizontal Full Sheet (HFS) test method described in the Test Methods section herein. In one example, the fibrous structures and/or sanitary tissue products according to the present invention exhibit an HFS absorbency of greater than about 5 g/g and/or greater than about 8 g/g and/or greater than about 10 g/g up to about 100 g/g. In another nonlimiting example, the fibrous structures and/or sanitary tissue products according to the present invention exhibit an HFS absorbency of from about 12 g/g to about 30 μg.

In one example, the fibrous structures of the present invention and/or sanitary tissue products of the present invention exhibit a VFS of greater than about 5 g/g and/or greater than about 8 g/g and/or greater than about 9.5 g/g and/or greater than about 9.6 g/g and/or greater than about 9.8 g/g and/or greater than about 10 g/g and/or greater than about 10.2 g/g and/or greater than about 10.4 g/g and/or greater than about 10.5 g/g up to about 20 g/g and/or up to about 14 g/g and/or up to about 12 g/g.

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Non-Woven Fibrous Structure

The fibrous structures of the present invention may be homogeneous or may be layered. If layered, the fibrous structures may comprise at least two and/or at least three and/or at least four and/or at least five layers.

In one example, the fibrous structure in accordance with the present invention may be selected from the group consisting of: through-air-dried fibrous structures, differential density fibrous structures, differential basis weight fibrous structures, wet laid fibrous structures, air laid fibrous structures, conventional dried fibrous structures, creped or uncreped fibrous structures, patterned-densified or non-patterned-densified fibrous structures, compacted or uncompacted, especially high bulk uncompacted, fibrous structures, other non-woven fibrous structures comprising synthetic or multicomponent fibers, homogeneous or multilayered fibrous structures, double re-creped fibrous structures, uncreped fibrous structures, co-form fibrous structures and mixtures thereof.

The fibrous structures of the present invention and/or sanitary tissue products of the present invention may comprise a surface that comprises undulations.

The fibrous structures of the present invention and/or sanitary tissue products of the present invention may comprise an embossment.

In one example, an air laid fibrous structure of the present invention may be selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

The fibrous structure may be pattern densified. A pattern densified fibrous structure is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field.

The fibrous structure may be uncompacted, non pattern-densified. The fibrous structure may be of a homogenous or multilayered construction. The fibrous structure may be made with a fibrous furnish that produces a single layer embryonic fibrous web or a fibrous furnish that produces a multi-layer embryonic fibrous web.

In one example, the fibrous structure of the present invention comprises 100% or about 100% by weight, on a dry fibrous structure basis of naturally occurring fibers, for example wood pulp fibers.

In another example, the fibrous structure of the present invention comprises from about 100% to about 10% and/or from about 100% to about 30% and/or from about 100% to about 50% and/or from about 100% to about 75% by weight, on a dry fibrous structure basis of naturally occurring fibers, for example wood pulp fibers. The other fibers, if any, in this type of fibrous structure may be non-naturally occurring fibers such as synthetic fibers, continuous, substantially continuous or staple synthetic fibers.

The fibrous structures of the present invention may comprise any suitable ingredients known in the art. Nonlimiting examples of suitable ingredients that may be included in the fibrous structures include permanent and/or temporary wet strength resins, dry strength resins, softening agents, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers, opacifying agents, bonding agents, debonding agents, colorants, and mixtures thereof. Such ingredients, when present in the fibrous structure of the present invention, may be present at any level based on the dry weight of the fibrous structure. Typically, such ingredients, when present, may be present at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention and/or sanitary tissue products of the present invention may exhibit a flex modulus of less than about 0.30 GM Bmean as measured by the Flex Modulus Test Method described herein. In one example, the fibrous structure of the present invention and/or sanitary tissues product of the present invention may exhibit a flex modulus of less than about 0.25 GM Bmean and/or less than about 0.24 GM Bmean and/or less than about 0.23 GM Bmean and/or to about 0.10 GM Bmean and/or to about 0.12 GM Bmean and/or to about 0.14 GM Bmean and/or to about 0.16 GM Bmean and/or to about 0.19 GM Bmean.

The fibrous structures of the present invention and/or sanitary tissue products comprising such fibrous structures may have a basis weight of less than about 120 g/m$^2$ and/or from about 10 g/m$^2$ to about 120 g/m$^2$ and/or from about 14 g/m$^2$ to about 80 g/m and/or from about 20 g/m$^2$ to about 60 g/m$^2$.

The fibrous structures of the present invention and/or sanitary tissue products comprising such fibrous structures may have a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structures of the present invention and/or sanitary tissue products comprising such fibrous structures may have a density of about 0.60 g/cc or less and/or about 0.30 g/cc or less and/or from about 0.04 g/cc to about 0.20 g/cc.

The fibrous structure of the present invention may be combined with one or more additional fibrous structures the same or different from the fibrous structure of the present invention to form a multi-ply sanitary tissue product. The additional fibrous structure may be combined with the fibrous structure of the present invention by any suitable means.

When combined with one or more additional fibrous structures, the same or different from the fibrous structures of the present invention to form a multi-ply sanitary tissue product, the tufts, if any, present in/on the fibrous structures may be oriented either inwardly such that the tufts do not form part of an external surface of the sanitary tissue product or outwardly such that the tufts do form part of an external surface of the sanitary tissue product. In one example, tufts of two different fibrous structures of the present invention of a multi-ply sanitary tissue product may contact one another by being oriented inwardly such that the tufts do not form part of an external surface of the sanitary tissue product. However, the tufts of the fibrous structures may be separated from one another by one or more additional fibrous structures the same or different from the fibrous structures of the present invention. Alternatively, tufts of two different fibrous structures of the present invention of a multi-ply sanitary tissue product may be oriented differently, one fibrous structure having the tufts oriented outwardly such that the tufts form part of an external surface of the sanitary tissue product and one fibrous structure having tufts oriented inwardly such that the tufts do not form part of an external surface of the sanitary tissue product. In another example, tufts of two different fibrous structures of the present invention of a multi-ply sanitary tissue product may both be oriented outwardly such that the tufts form a part of the external surfaces of the sanitary tissue product.

The fibrous structure of the present invention and the additional fibrous structure may exhibit different stretch properties at peak load. For example the fibrous structure of the present invention may exhibit a stretch at peak load that is less than the stretch at peak load of the additional fibrous structure.

In other examples, the fibrous structure of the present invention or portions thereof may exhibit a greater stretch at peak load than the additional fibrous structure or portions thereof.

Processes for Making a Fibrous Structure

The non-woven fibrous structure and/or sanitary tissue product comprising such non-woven fibrous structure may be made from any suitable fibrous, structure making process so long as the non-woven fibrous structure exhibits Flex Modulus, Wet Caliper, Dry Caliper and/or VFS properties that facilitate consumers of the fibrous structure to associate the fibrous structure with cloth.

Nonlimiting examples of processes for making non-woven fibrous structures of the present invention include known wet-laid papermaking processes, air-laid papermaking processes, meltblown fibrous structure making processes, spunbond fibrous structure making processes and conform fibrous structure making processes. For the wet-laid and/or air-laid processes, the processes typically include steps of preparing a fiber composition in the form of a suspension in a medium, either wet, more specifically aqueous medium, or dry, more specifically gaseous, i.e. with air as medium. The suspension of fibers is then deposited onto a forming wire or belt such that an embryonic fibrous structure comprising a plurality of fibers is formed. The embryonic fibrous structure (web) is then subjected to drying and/or bonding of fibers operation, which results in a non-woven web (which may also be the finished non-woven fibrous structure). Further processing of the non-woven web may be carried out such that a finished non-woven fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structure may be subjected to one or more of the following process steps: 1) forming the web on a structured through-air-drying fabric, 2) foreshortening, 3) creping, 4) wet microcontracting, and/or 5) rush transferring. Alternatively, the web (e.g., fibrous structure) may not be foreshortened.

Figure 4:
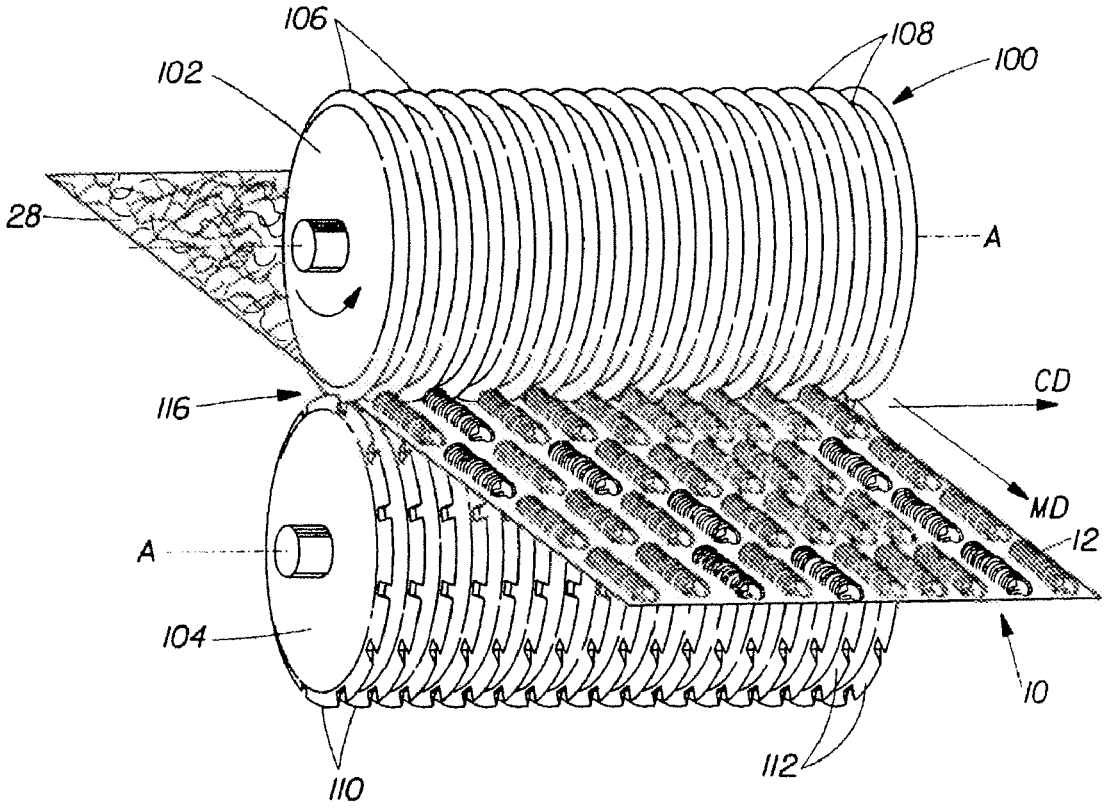
FIG. 4 is a perspective view of an apparatus for forming a fibrous structure according to the present invention.

FIG. 4 shows a nonlimiting example of an apparatus and process for making a fibrous structure that exhibits Flex Modulus, Wet Caliper, Dry Caliper and/or VFS properties that facilitate consumers of the fibrous structure to associate the fibrous structure with cloth. The exemplified process is an example of a tuft generating operation. The apparatus 100 comprises a pair of intermeshing rolls 102 and 104, each rotating about an axis A, the axes A being parallel in the same plane. Roll 102 comprises a plurality of ridges 106 and corresponding grooves 108 which extend unbroken about the entire circumference of roll 102. Roll 104 is similar to roll 102, but rather than having ridges that extend unbroken about the entire circumference, roll 104 comprises a plurality of rows of circumferentially-extending ridges that have been modified to be rows of circumferentially-spaced teeth 110 that extend in spaced relationship about at least a portion of roll 104. The individual rows of teeth 110 of roll 104 are separated by corresponding grooves 112. In operation, rolls 102 and 104 intermesh such that the ridges 106 of roll 102 extend into the grooves 112 of roll 104 and the teeth 110 of roll 104 extend into the grooves 108 of roll 102. The intermeshing is shown in greater detail in the cross sectional representation of FIG. 5, discussed below.

In FIG. 4, the apparatus 100 is shown having one patterned roll, e.g., roll 104, and one non-patterned grooved roll 102. However, in certain examples it may be desirable to use two patterned rolls 104 having either the same or differing patterns, in the same or different corresponding regions of the respective rolls. Such an apparatus can produce fibrous structures with tufts protruding from both sides of the fibrous structure.

The process of the present invention is similar in many respects to a process as described in U.S. Pat. No. 5,518,801 entitled "Web Materials Exhibiting Elastic-Like Behavior" and referred to in subsequent patent literature as "SELF" webs, which stands for "Structural Elastic-like Film". However, there are significant differences between the apparatus of the present invention and the apparatus disclosed in the above-identified '801 patent. These differences account for the novel features of the web of the present invention. As described below, the teeth 110 of roll 104 have a specific geometry associated with the leading and trailing edges that permit the teeth, e.g., teeth 110, to essentially "punch" through the fibrous structure 28 as opposed to, in essence, emboss the web. The difference in the apparatus 100 of the present invention results in a fundamentally different fibrous structure.

Fibrous structure 28 is provided either directly from a web making process or indirectly from a supply roll (neither shown) and moved in the machine direction to the nip 116 of counter-rotating intermeshing rolls 102 and 104. Fibrous structure 28 can be any suitable fibrous structure that exhibits or is capable of exhibiting sufficient stretch at peak load to permit formation of tufts in the fibrous structure. Fibrous structure 28 can be plasticized by any means known in the art, such as by subjecting the precursor web to a humid environment. As fibrous structure 28 goes through the nip 116 the teeth 110 of roll 104 enter grooves 108 of roll 102 and simultaneously urge fibers out of the plane of plane of fibrous structure 28 to form tufts 12 and discontinuities 22, not shown in FIG. 4. In effect, teeth 110 "push" or "punch" through fibrous structure 28. As the tip of teeth 110 push through fibrous structure 28 the portions of fibers that are oriented predominantly in the CD and across teeth 110 are urged by the teeth 110 out of the plane of fibrous structure 28 and are stretched, pulled, and/or plastically deformed in the z-axis, resulting in formation of the tuft 12. Fibers that are predominantly oriented generally parallel in the machine direction of fibrous structure 28 as shown in FIG. 4, are simply spread apart by teeth 110 and remain substantially in the non-tufted region of the fibrous structure 10. The number, spacing, and size of tufts can be varied by changing the number, spacing, and size of teeth 110 and making corresponding dimensional changes as necessary to roll 104 and/or roll 102. This variation, together with the variation possible in fibrous structures 28 and line speeds, permits many varied fibrous structures to be made for many purposes. For example, a fibrous structure made from a high basis weight textile fabric having MD and CD woven extensible threads could be made into a soft, porous ground covering, such as a cow carpet useful for reducing udder and teat problems in cows. A fibrous structure made from a relatively low basis weight nonwoven web of extensible spunbond polymer fibers could be used as a terry cloth-like fabric for semi-durable or durable clothing.

Figure 5:
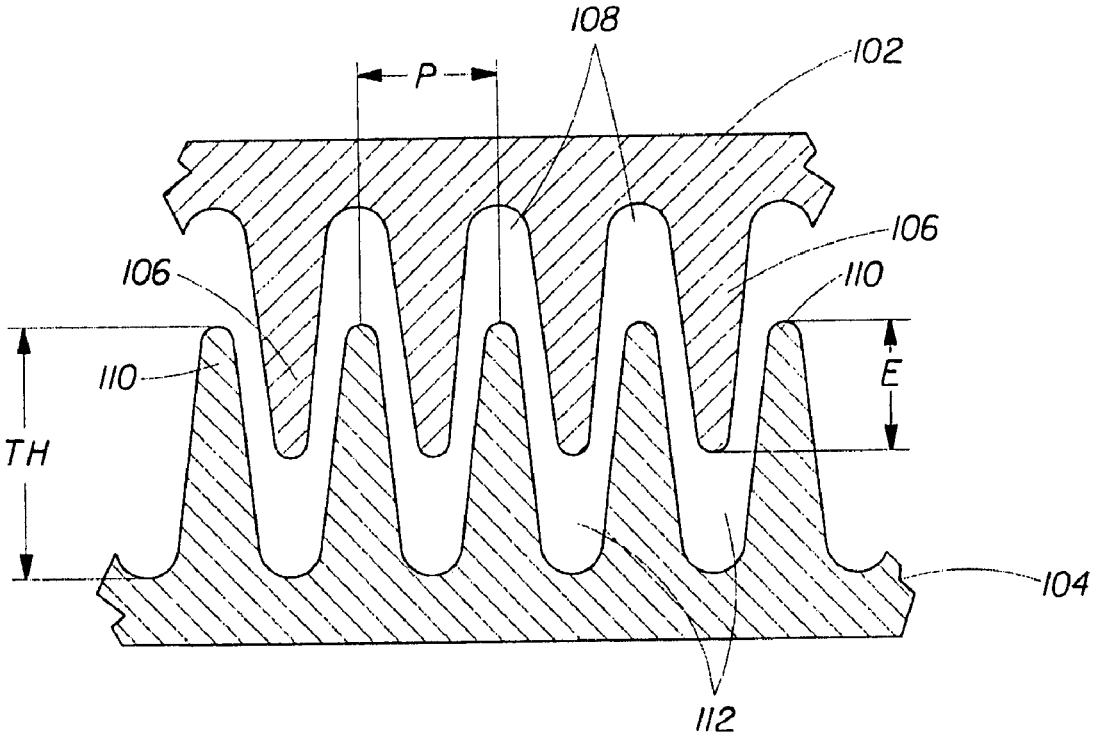
FIG. 5 is a cross-sectional depiction of the apparatus shown in FIG. 4.

FIG. 5 shows in cross section a portion of the intermeshing rolls 102 and 104 including ridges 106 and teeth 110. As shown teeth 110 have a tooth height TH (note that TH can also be applied to ridge 106 height; in a preferred example tooth height and ridge height are equal), and a tooth-to-tooth spacing (or ridge-to-ridge spacing) referred to as the pitch P. As shown, depth of engagement E is a measure of the level of intermeshing of rolls 102 and 104 and is measured from tip of ridge 106 to tip of tooth 110. The depth of engagement E, tooth height TH, and pitch P can be varied as desired depending on the properties of the precursor web and the desired characteristics of fibrous structure. Also, the greater the density of the tufted regions desired (tufted regions per unit area of fibrous structure), the smaller the pitch should be, and the smaller the tooth length TL and tooth distance TD should be, as described below.

Figure 6:
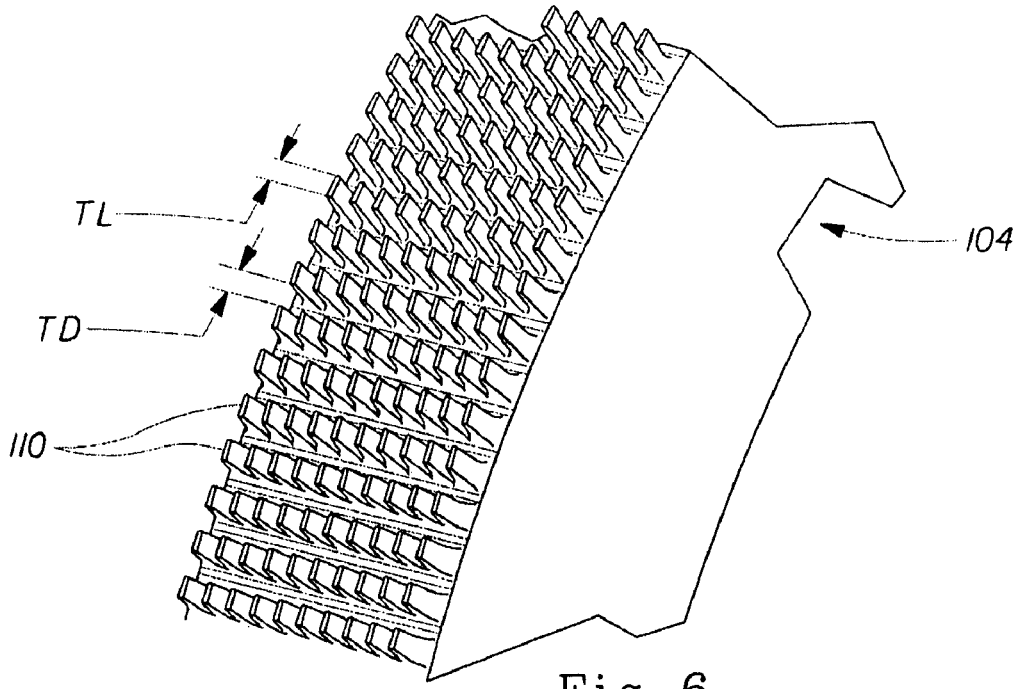
FIG. 6 is a perspective view of a portion of the apparatus of FIG. 4 for forming a fibrous structure of the present invention.
Figure 7:
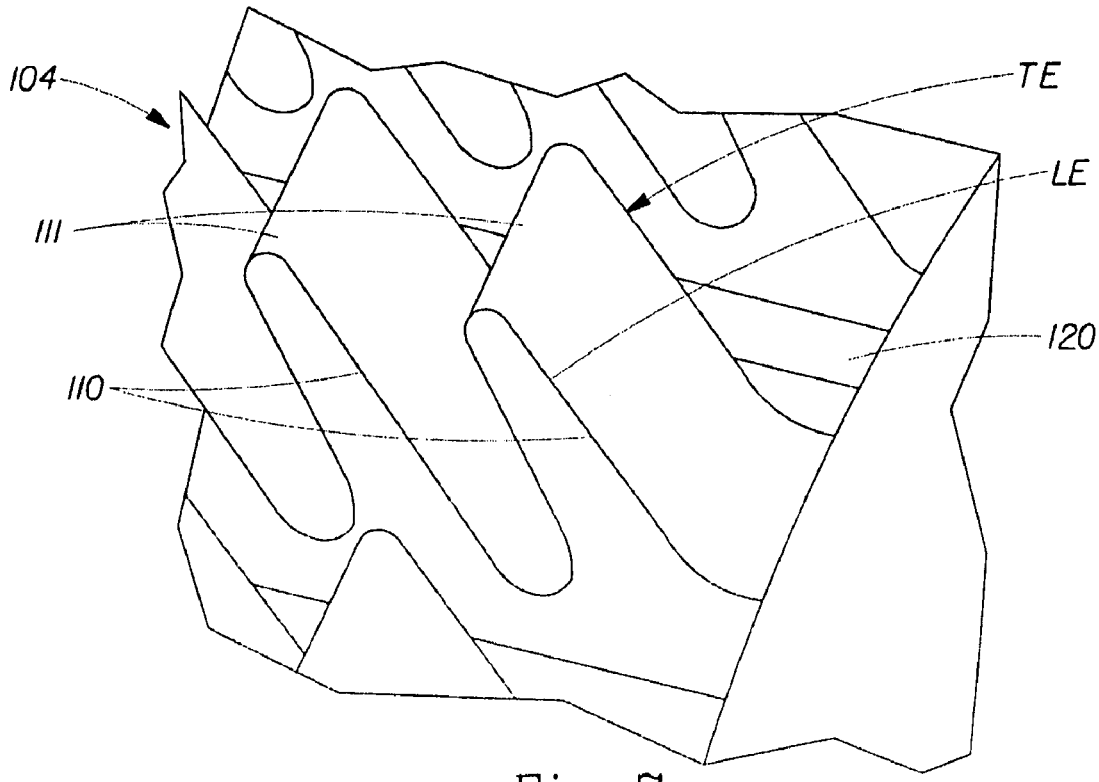
FIG. 7 is an enlarged perspective view of a portion of the apparatus of FIG. 6.

FIG. 6 shows one example of a roll 104 having a plurality of teeth 110 useful for making a fibrous structure of the present invention having a basis weight of less than about 120 $g/m^2$ and/or from about 10 $g/m^2$ to about 120 $g/m^2$ and/or from about 14 $g/m^2$ to about 100 $g/m^2$ and/or from about 20 $g/m^2$ to about 90 $g/m^2$ and/or from about 20 $g/m^2$ to about 60 $g/m^2$ and/or from about 25 $g/m^2$ to about 60 $g/m^2$. In one example, the resulting fibrous structure of the present invention exhibits a basis weight of from about 18 $g/m^2$ to about 50 $g/m^2$ and/or from about 15 $g/m^2$ to about 40 $g/m^2$. An enlarged view of teeth 110 shown in FIG. 6 is shown in FIG. 7. In this example of roll 104 teeth 110 have a uniform circumferential length dimension TL of about 1.25 mm measured generally from the leading edge LE to the trailing edge TE at the tooth tip 111, and are uniformly spaced from one another circumferentially by a distance TD of about 1.5 mm. For making a fibrous structure from a precursor web having a basis weight in the range of about 15 gsm to 100 gsm, teeth 110 of roll 104 can have a length TL ranging from about 0.5 mm to about 3 mm and a spacing TD from about 0.5 mm to about 3 mm, a tooth height TH ranging from about 0.5 mm to about 10 mm, and a pitch P between about 1 mm (0.040 inches) and 2.54 mm (0.100 inches). Depth of engagement E can be from about 0.5 mm to about 5 mm (up to a maximum approaching the tooth height TH). Of course, E, P, TH, TD and TL can each be varied independently of each other to achieve a desired size, spacing, and area density of tufts (number of tufts per unit area of fibrous structure).

As shown in FIG. 7, each tooth 110 has a tip 111, a leading edge LE and a trailing edge TE. The tooth tip 111 is elongated and has a generally longitudinal orientation, corresponding to the longitudinal axes L of tufted regions. It is believed that to get the tufts of the fibrous structure that can be described as being terry cloth-like, the LE and TE should be very nearly orthogonal to the local peripheral surface 120 of roll 104. As well, the transition from the tip 111 and the LE or TE should be a sharp angle, such as a right angle, having a sufficiently small radius of curvature such that, in use the teeth 110 push through precursor web at the LE and TE. Without being bound by theory, it is believed that having relatively sharply angled tip transitions between the tip of tooth 110 and the LE and TE permits the teeth 110 to punch through precursor web "cleanly", that is, locally and distinctly, so that the resulting fibrous structure can be described as "tufted" in tufted regions rather than "embossed" for example. When so processed, the fibrous structure is not imparted with any particular elasticity, beyond what the precursor web may have possessed originally.

Although the fibrous structure of the present invention is disclosed in preferred examples as a single ply fibrous structure made from a single ply precursor web, it is not necessary that it be so. For example, a laminate or composite precursor web having two or more plies can be used so long as one of the plies is a fibrous structure according to the present invention. In general, the above description for the fibrous structure holds, recognizing that tufted, aligned fibers, for example, formed from a laminate precursor web would be comprised of fibers from both (or all) plies of the laminate. In such a fibrous structure, it is important, therefore, that all the fibers of all the plies have sufficient diameter, elongation characteristics, and fiber mobility, so as not to break prior to extension and tufting. In this manner, fibers from all the plies of the laminate may contribute to the tufts. In a multi-ply fibrous structure, the fibers of the different plies may be mixed or intermingled in the tuft and/or tufted regions. The fibers may not protrude through but combine with the fibers in an adjacent ply.

The fibrous structures of the present invention, in addition to being used as web products, may also be used for a wide variety of other applications. Nonlimiting examples of such other applications include various filter sheets such as air filter, bag filter, liquid filter, vacuum filter, water drain filter, and bacterial shielding filter; sheets for various electric appliances such as capacitor separator paper, and floppy disk packaging material; beach mat; various industrial sheets such as tacky adhesive tape base cloth, oil absorbing material, and paper felt; various wiper sheets such as wipers for homes, services and medical treatment, printing roll wiper, wiper for cleaning copying machine, and wiper for optical systems; hygiene or personal cleansing wiper such as baby wipes, feminine wipes, facial wipes, or body wipes, various medicinal and sanitary sheets, such as surgical gown, gown, covering cloth, cap, mask, sheet, towel, gauze, base cloth for cataplasm, diaper, diaper core, diaper acquisition layer, diaper liner, diaper cover, base cloth for adhesive plaster, wet towel, and tissue; various sheets for clothes, such as padding cloth, pad, jumper liner, and disposable underwear; various life material sheets such as base cloth for artificial leather and synthetic leather, table top, wall paper, shoji-gami (paper for paper screen), blind, calendar, wrapping, and packages for drying agents, shopping bag, suit cover, and pillow cover; various agricultural sheets, such as cow carpets, cooling and sun light-shielding cloth, lining curtain, sheet for overall covering, light-shielding sheet and grass preventing sheet, wrapping materials of pesticides, underlining paper of pots for seeding growth; various protection sheets such as fume prevention mask and dust prevention mask, laboratory gown, and dust preventive clothes; various sheets for civil engineering building, such as house wrap, drain material, filtering medium, separation material, overlay, roofing, tuft and carpet base cloth, wall interior material, soundproof or vibration reducing sheet, and curing sheet; and various automobile interior sheets, such as floor mat and trunk mat, molded ceiling material, head rest, and lining cloth, in addition to a separator sheet in alkaline batteries.

Another advantage of the process described to produce the fibrous structures of the present invention is that the fibrous structures can be produced in-line with other fibrous structure production equipment. Additionally, there may be other solid state formation processes that can be used either prior to or after the process of the present invention. Nonlimiting examples of suitable solid state formation processes include printing, embossing, laminating, slitting, perforating, cutting edges, stacking, folding, mechanical softening, and the like.

As can be understood from the above description of the fibrous structures and methods for making such fibrous structure of the present invention, many various fibrous structures can be made without departing from the scope of the present invention as claimed in the appended claims. For example, fibrous structures can be coated or treated with lotions, medicaments, cleaning fluids, anti-bacterial solutions, emulsions, fragrances, surfactants.

NONLIMITING EXAMPLES

Example 1

A fibrous structure in accordance with the present invention is made on a pilot wet-laid papermaking machine. A homogeneous blend of 70% NSK fibers, 20% Eucalyptus fibers and 10% Co-PET/PET (sheath/core) staple fibers is used to make the fibrous structure. 25#/ton of Kymene (permanent wet strength agent), 6#/ton carboxymethylcellulose and 4#/ton of DTDMAMS is mixed into the fiber slurry. The fibrous structure is formed on a three-dimensional molded through-air-dried belt. The papermaking machine is run at 17.1% wet microcontraction (i.e., a papermaking belt that transfers the web to a through-air-dried fabric is running faster than the through-air-dried fabric) and 19% crepe off a Yankee dryer. The fibrous structure is then passed through a tuft generating operation wherein the tuft generating roll has a depth of engagement of about 0.042". This tufted ply of fibrous structure is combined with a non-tufted ply of fibrous structure made by the same process except without passing through the tuft generating operation. The two plies are combined using an embossing process. The resulting fibrous structure is a non-woven fibrous structure that exhibits a flex modulus of 0.22 GM Bmean, a wet caliper of 30.5 mils, a dry caliper of 38.7 mils and a VFS of 10.4 g/g.

Example 2

A fibrous structure in accordance with the present invention is made on a pilot wet-laid papermaking machine. A homogeneous blend of 70% NSK fibers, 20% Eucalyptus fibers and 10% Co-PET/PET (sheath/core) staple fibers is used to make the fibrous structure. 25#/ton of Kymene (permanent wet strength agent), 6#/ton carboxymethylcellulose and 4#/ton of DTDMAMS is mixed into the fiber slurry. The fibrous structure is formed on a three-dimensional molded through-air-dried belt. The papermaking machine is run at 17.1% wet microcontraction (i.e., a papermaking belt that transfers the web to a through-air-dried fabric is running faster than the through-air-dried fabric) and 19% crepe off a Yankee dryer. The fibrous structure is then passed through a tuft generating operation wherein the tuft generating roll has a depth of engagement of about 0.012". Two plies of the fibrous structures comprising tufts are combined using an embossing process. The resulting fibrous structure is a non-woven fibrous structure that exhibits a flex modulus of 0.25 GM Bmean, a wet caliper of 27.9 mils, a dry caliper of 29.3 mils and a VFS of 19.6 g/g.

Example 3

A fibrous structure in accordance with the present invention is made on a pilot wet-laid papermaking machine. A homogeneous blend of 75% NSK fibers and 25% Eucalyptus fibers is used to make the fibrous structure. 25#/ton of Kymene (permanent wet strength agent), 6#/ton carboxymethylcellulose and 4#/ton of DTDMAMS is mixed into the fiber slurry. The fibrous structure is formed on a three-dimensional molded through-air-dried belt. The papermaking machine is run at 17.1% wet microcontraction (i.e., a papermaking belt that transfers the web to a through-air-dried fabric is running faster than the through-air-dried fabric) and 19% crepe off a Yankee dryer. The fibrous structure is then passed through a tuft generating operation wherein the tuft generating roll has a depth of engagement of about 0.042". This tufted ply of fibrous structure is combined with a non-tufted ply of fibrous structure made by the same process except without passing through the tuft generating operation. The two plies are combined using an embossing process. The resulting fibrous structure is a non-woven fibrous structure that exhibits a flex modulus of 0.22 GM Bmean, a wet caliper of 28.1 mils, a dry caliper of 39.8 mils and a VFS of 10.5 g/g.

Example 4

A fibrous structure in accordance with the present invention is made on a pilot wet-laid papermaking machine. A homogeneous blend of 70% NSK fibers, 20% Eucalyptus fibers and 10% Co-PET/PET (sheath/core) staple fibers is used to make the fibrous structure. 25#/ton of Kymene (permanent wet strength agent), 6#/ton carboxymethylcellulose and 4#/ton of DTDMAMS is mixed into the fiber slurry. The fibrous structure is formed on a three-dimensional molded through-air-dried belt. The papermaking machine is run at 17.1% wet microcontraction (i.e., a papermaking belt that transfers the web to a through-air-dried fabric is running faster than the through-air-dried fabric) and 19% crepe off a Yankee dryer. Two plies of the fibrous structures are combined using an embossing process. The resulting fibrous structure is a non-woven fibrous structure that exhibits a flex modulus of 0.23 GM Bmean, a wet caliper of 27.3 mils, a dry caliper of 29.1 mils and a VFS of 19.4 g/g.

Example 5

A fibrous structure in accordance with the present invention is made on a pilot wet-laid papermaking machine. A homogeneous blend of 75% NSK fibers and 25% Eucalyptus fibers is used to make the fibrous structure. 25#/ton of Kymene (permanent wet strength agent), 6#/ton carboxymethylcellulose and 4#/ton of DTDMAMS is mixed into the fiber slurry. The fibrous structure is formed on a three-dimensional molded through-air-dried belt. The papermaking machine is run at 3% wet microcontraction (i.e., a papermaking belt that transfers the web to a through-air-dried fabric is running faster than the through-air-dried fabric) and 10% crepe off a Yankee dryer. The fibrous structure is then passed through a tuft generating operation wherein the tuft generating roll has a depth of engagement of about 0.032". This tufted ply of fibrous structure is combined with a non-tufted ply of fibrous structure made by the same process except without passing through the tuft generating operation. The two plies are combined using an embossing process. The resulting fibrous structure is a non-woven fibrous structure that exhibits a flex modulus of 0.22 GM Bmean, a wet caliper of 29.2 mils, a dry caliper of 35.8 mils and a VFS of 9.8 g/g.

Test Methods

Unless otherwise indicated, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. Further, all tests are conducted in such conditioned room. Tested samples should be subjected to 73° F.±4° F. (about 23° C.±2.2° C.) and a relative humidity of 50%±10% for 24 hours prior to testing.

Flex Modulus Test Method

The Flex Modulus is a measurement of the bending stiffness of the fibrous structure and/or sanitary tissue product comprising a fibrous structure herein. The following procedure can be used to determine the bending stiffness of paper product. The Kawabata Evaluation System-2, Pure Bending Tester (i.e.; KES-FB2, manufactured by a Division of Instrumentation, Kato Tekko Company, Ltd. of Kyoto, Japan) may be used for this purpose.

Samples of the paper product to be tested are cut to approximately 20×20 cm in the machine and cross machine direction. The sample width is measured to 0.01 inches (0.025 cm). The outer ply (i.e.; the ply that is facing outwardly on a roll of the paper sample) and inner ply as presented on the roll are identified and marked.

The sample is placed in the jaws of the KES-FB2 Auto A such that the sample is first bent with the outer ply undergoing compression and the inner ply undergoing tension. In the orientation of the KES-FB2 the outer ply is right facing and the inner ply is left facing. The distance between the front moving jaw and the rear stationary jaw is 1 cm. The sample is secured in the instrument in the following manner. First the front moving chuck and the rear stationary chuck are opened to accept the sample. The sample is inserted midway between the top and bottom of the jaws such that the machine direction of the sample is parallel to the jaws (i.e.; vertical in the KES-FB2 holder).

The rear stationary chuck is then closed by uniformly tightening the upper and lower thumb screws until the sample is snug, but not overly tight. The jaws on the front stationary chuck are then closed in a similar fashion. The sample is adjusted for squareness in the chuck, then the front jaws are tightened to insure the sample is held securely. The distance (d) between the front chuck and the rear chuck is 1 cm.

The output of the instrument is load cell voltage (Vy) and curvature voltage (Vx). The load cell voltage is converted to a bending moment normalized for sample width (M) in the following manner:

$$\text{Moment}(M,\text{gf*cm/cm})=(Vy*Sy*d)/W$$

where Vy is the load cell voltage; Sy is the instrument sensitivity in gf*cm/V; d is the distance between the chucks; and W is the sample width in centimeters.

The sensitivity switch of the instrument is set at 5×1. Using this setting the instrument is calibrated using two 50 gram weights. Each weight is suspended from a thread. The thread is wrapped around the bar on the bottom end of the rear stationary chuck and hooked to a pin extending from the front and back of the center of the shaft. One weight thread is wrapped around the front and hooked to the back pin. The other weight thread is wrapped around the back of the shaft and hooked to the front pin. Two pulleys are secured to the instrument on the right and left side. The top of the pulleys are horizontal to the center pin. Both weights are then hung over the pulleys (one on the left and one on the right) at the same time. The full scale voltage is set at 10 V. The radius of the center shaft is 0.5 cm. Thus the resultant full scale sensitivity (Sy) for the Moment axis is 100 gf*0.5 cm/10V (5 gf*cm/V).

The output for the Curvature axis is calibrated by starting the measurement motor and manually stopping the moving chuck when the indicator dial reaches the stop. The output voltage (Vx) is adjusted to 0.5 volts. The resultant sensitivity (Sx) for the curvature axis is 2/(volts*cm). The curvature (K) is obtained in the following manner:

$$\text{Curvature}(K,\text{cm}^{-1})=Sx*Vx$$

where Sx is the sensitivity of the curvature axis; and Vx is the output voltage.

For determination of the bending stiffness the moving chuck is cycled from a curvature of 0 $cm^{-1}$ to +2.5 $cm^{-1}$ to −2.5 $cm^{-1}$ to 0 $cm^{-1}$ at a rate of 0.5 $cm^{-1}$/sec. Each sample is cycled once. The output voltage of the instrument is recorded in a digital format using a personal computer. At the start of the test there is no tension on the sample. As the test begins the load cell begins to experience a load as the sample is bent. The initial rotation is clockwise when viewed from the top down on the instrument.

The load continues to increase until the bending curvature reaches approximately +2.5 $cm^{-1}$ (this is the Forward Bend (FB)). At approximately +2.5 $cm^{-1}$ the direction of rotation was reversed. During the return the load cell reading decreases: This is the Forward Bend Return (FR). As the rotating chuck passes 0, curvature begins in the opposite direction. The Backward Bend (BB) and Backward Bend Return (BR) is obtained.

The data was analyzed in the following manner. A linear regression line is obtained, between approximately 0.5 and 1.5 $cm^{-1}$ for the Forward Bend (FB). The slope of the line is reported as the Bending Stiffness (B) or Flex Modulus, in units of gf*$cm^2$/cm. The method is repeated with the sample oriented such that the cross direction is parallel to the jaws. Three or more separate samples are run. The reported values are the geometric mean (GM) of the averages of the BFB on the MD and CD samples. Therefore, the GM Bmean is determined by the following equation: GM Bmean=$(MD_{average} \times CD_{average})^{1/2}$.

Wet Caliper Test Method

The Wet Caliper of a sample of fibrous structure and/or sanitary tissue product comprising a fibrous structure is determined by cutting a sample of the fibrous structure and/or sanitary tissue product comprising a fibrous structure such that it is larger in size than a load foot loading surface where the load foot loading surface has a circular surface area of about 3.14 $in^2$. Each sample is wetted by submerging the sample in a distilled water bath for 30 seconds. The caliper of the wet sample is measured within 30 seconds of removing the sample from the bath. The sample is then confined between a horizontal flat surface and the load foot loading surface. The load foot loading surface applies a confining pressure to the sample of 14.7 g/$cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in mils.

Dry Caliper Test Method

The Dry Caliper of a sample of fibrous structure and/or sanitary tissue product comprising a fibrous structure is determined by cutting a sample of the fibrous structure and/or sanitary tissue product comprising a fibrous structure such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 14.7 g/$cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in mils.

VFS Test Method

The Vertical Full Sheet (VFS) test method determines the amount of distilled water absorbed and retained by the fibrous structure sample and/or sanitary tissue product sample of the present invention after the sample has been wetted and drained in both a horizontal and vertical position. This method is performed by first weighing a sample of the fibrous structure and/or sanitary tissue product to be tested (referred to herein as the "dry weight of the sample"), then thoroughly wetting the sample, draining the wetted sample in a horizontal position, then in a vertical position and then reweighing (referred to herein as "wet weight of the sample"). The absorptive capacity of the sample is then computed as the amount of water retained in units of grams of water absorbed by the sample. When evaluating different fibrous structure samples and/or different sanitary tissue product samples, the same size of fibrous structure or sanitary tissue product is used for all samples tested.

The apparatus for determining the VFS capacity of fibrous structures and/or sanitary tissue products comprises the following: 1) An electronic balance with a sensitivity of at least 0.01 grams and a minimum capacity of 1200 grams. The balance should be positioned on a balance table and slab to minimize the vibration effects of floor/benchtop weighing. The balance should also have a special balance pan to be able to handle the size of the sample tested (i.e.; a fibrous structure sample of about 11 in. (27.9 cm) by 11 in. (27.9 cm)). The balance pan can be made out of a variety of materials. Plexiglass is a common material used; 2) A sample support rack and sample support cover is also required. Both the rack and cover are comprised of a lightweight metal frame, strung with 0.012 in. (0.305 cm) diameter monofilament so as to form a grid of 0.5 inch squares (1.27 $cm^2$). The size of the support rack and cover is such that the sample size can be conveniently placed between the two.

The VFS test is performed in an environment maintained at 23±1° C. and 50±2% relative humidity. A water reservoir or tub is filled with distilled water at 23±1° C. to a depth of 3 inches (7.6 cm).

The fibrous structure sample and/or sanitary tissue product to be tested is carefully weighed on the balance to the nearest 0.01 grams. The dry weight of the sample is reported to the nearest 0.01 grams. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain horizontally for 120±5 seconds, taking care not to excessively shake or vibrate the sample. While the sample is draining, the rack cover is carefully removed and all excess water is wiped from the support rack. The wet sample and the support rack are weighed on the previously tared balance. The weight is recorded to the nearest 0.01 g. This is the wet weight of the sample.

The gram per fibrous structure sample and/or sanitary tissue product sample absorptive capacity of the sample is defined as (wet weight of the sample−dry weight of the sample). The vertical full sheet absorbent capacity (VFS) is defined as: VFS=(wet weight of the sample−dry weight of the sample)/(dry weight of the sample) and has a unit of gram/gram.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet-laid fibrous structure comprising from about 10% to about 100% by weight on a dry fibrous structure basis of naturally occurring fibers and a plurality of tufts, wherein the fibrous structure exhibits a Wet Caliper of greater than 25 mils and a Flex Modulus of less than about 0.25 GM Bmean.

2. The fibrous structure according to claim 1 wherein the fibrous structure exhibits a wet caliper of greater than about 26 mils.

3. The fibrous structure according to claim 1 wherein the fibrous structure exhibits a Flex Modulus of less than about 0.24 GM Bmean.

4. The fibrous structure according to claim 1 wherein the fibrous structure exhibits a basis weight of less than about 120 $g/m^2$.

5. The fibrous structure according to claim 1 wherein the fibrous structure comprises an embossment.

6. The fibrous structure according to claim 1 wherein the fibrous structure comprises two or more regions that exhibit different densities.

7. The fibrous structure according to claim 1 wherein the fibrous structure comprises a surface comprising undulations.

8. A single- or multi-ply sanitary tissue product comprising a fibrous structure according to claim 1.

9. The sanitary tissue product according to claim 8 wherein the sanitary tissue product is in roll form.

10. A wet-laid fibrous structure comprising from about 10% to about 100% by weight on a dry fibrous structure basis of naturally occurring fibers and a plurality of tufts, wherein the fibrous structure exhibits a wet caliper of greater than 23 mils and a VFS of greater than 10.2 g/g.

11. The fibrous structure according to claim 10 wherein the fibrous structure exhibits a wet caliper of greater than about 24 mils.

12. The fibrous structure according to claim 10 wherein the fibrous structure exhibits a VFS of greater than about 10.4 g/g.

13. The fibrous structure according to claim 10 wherein the fibrous structure exhibits a basis weight of less than about 120 $g/m^2$.

14. The fibrous structure according to claim 10 wherein the fibrous structure comprises an embossment.

15. The fibrous structure according to claim 10 wherein the fibrous structure comprises two or more regions that exhibit different densities.

16. The fibrous structure according to claim 10 wherein the fibrous structure comprises a surface comprising undulations.

17. A single- or multi-ply sanitary tissue product comprising a fibrous structure according to claim 10.

18. The sanitary tissue product according to claim 17 wherein the sanitary tissue product is in roll form.

19. A wet-laid fibrous structure comprising from about 10% to about 100% by weight on a dry fibrous structure basis of naturally occurring fibers and a plurality of tufts, wherein the fibrous structure exhibits a dry caliper of greater than 31 mils and a VFS of greater than about 9.6 g/g.

20. The fibrous structure according to claim 19 wherein the fibrous structure exhibits a dry caliper of greater than 32 mils.

21. The fibrous structure according to claim 19 wherein the fibrous structure exhibits a VFS of greater than about 9.8 g/g.

22. The fibrous structure according to claim 19 wherein the fibrous structure exhibits a basis weight of less than about 120 $g/m^2$.

23. The fibrous structure according to claim 19 wherein the fibrous structure comprises an embossment.

24. The fibrous structure according to claim 19 wherein the fibrous structure comprises two or more regions that exhibit different densities.

25. The fibrous structure according to claim 19 wherein the fibrous structure comprises a surface comprising undulations.

26. A single- or multi-ply sanitary tissue product comprising a fibrous structure according to claim 19.

27. The sanitary tissue product according to claim 26 wherein the sanitary tissue product is in roll form.

* * * * *